US007004825B1

(12) United States Patent
Taylor et al.

(10) Patent No.: US 7,004,825 B1
(45) Date of Patent: Feb. 28, 2006

(54) APPARATUS AND ASSOCIATED METHOD FOR CONDITIONING IN CHEMICAL MECHANICAL PLANARIZATION

(75) Inventors: Travis R. Taylor, Fremont, CA (US); Robert Charatan, Portland, OR (US); Robert Anderson, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/674,941

(22) Filed: Sep. 29, 2003

(51) Int. Cl.
*B24B 53/00* (2006.01)

(52) U.S. Cl. ..... 451/72; 451/443

(58) Field of Classification Search ..... 451/72, 451/443, 444, 56, 24, 5, 288, 287, 307
See application file for complete search history.

(56) References Cited

U.S. PATENT DOCUMENTS 5,885,137 A * 3/1999 Ploessl ..... 451/56
5,975,994 A * 11/1999 Sandhu et al. ..... 451/56
6,190,243 B1 * 2/2001 Wada et al. ..... 451/288
6,508,697 B1 * 1/2003 Benner et al. ..... 451/443
6,648,731 B1 * 11/2003 Shin ..... 451/24

* cited by examiner

*Primary Examiner*—Robert A. Rose
(74) *Attorney, Agent, or Firm*—Martine Penilla & Gencarella, LLP

(57) ABSTRACT

A conditioning apparatus for use in a CMP system is provided along with an associated method of operation. The conditioning apparatus includes rotation mechanics and oscillation mechanics. The rotation mechanics are capable of rotating a shaft which causes a holder and a conditioning substrate to be rotated. The oscillation mechanics are capable of moving a position of the shaft within a region defined by a peripheral boundary that is less than and within an outer periphery of the conditioning substrate. A conditioning substrate backing is also included in the conditioning apparatus. The conditioning substrate backing defines a differential pressure distribution that is capable of being applied to the conditioning substrate.

12 Claims, 18 Drawing Sheets

APPARATUS AND ASSOCIATED METHOD FOR CONDITIONING IN CHEMICAL MECHANICAL PLANARIZATION

BACKGROUND OF THE INVENTION

1. Field of the Invention

The present invention relates generally to semiconductor fabrication. More specifically, the present invention relates to conditioning a working surface used in performing a chemical mechanical planarization (CMP) process.

2. Description of the Related Art

In the fabrication of semiconductor devices, planarization operations are often performed on a semiconductor wafer ("wafer") to provide polishing, buffing, and cleaning effects. Typically, the wafer includes integrated circuit devices in the form of multi-level structures defined on a silicon substrate. At a substrate level, transistor devices with diffusion regions are formed. In subsequent levels, interconnect metallization lines are patterned and electrically connected to the transistor devices to define a desired integrated circuit device. Patterned conductive layers are insulated from other conductive layers by a dielectric material. As more metallization levels and associated dielectric layers are formed, the need to planarize the dielectric material increases. Without planarization, fabrication of additional metallization layers becomes substantially more difficult due to increased variations in a surface topography of the wafer. In other applications, metallization line patterns are formed into the dielectric material, and then metal planarization operations are performed to remove excess metallization.

The CMP process is one method for performing wafer planarization. In general, the CMP process involves holding and contacting a rotating wafer against a working surface of a moving polishing pad. CMP systems typically configure the polishing pad on a rotary table or a linear belt. Additionally, the CMP process can include the use of varying degrees of abrasives, chemistries, and fluids to maximize effective use of friction between the wafer and the working surface of the polishing pad. The abrasives, chemistries, and fluids are combined to form a slurry that is introduced and distributed over the working surface of the polishing pad. Cleaning and conditioning of the working surface of the polishing pad can also be performed during processing to control interface conditions that exist between the wafer and the working surface.

The working surface of the polishing pad can be either porous or non-porous and generally incorporates topographical variations. During the CMP process, the working surface can become saturated and clogged with slurry and CMP process residue, particularly in low-lying and/or porous regions. Saturation and clogging of the working surface can introduce undesirable effects on the interface conditions between the wafer and working surface. The undesirable effects can be especially detrimental where minor changes in the interface conditions pose significant problems with the CMP process results (e.g., processing wafers having small feature sizes (<90 nanometers), processing wafers having relatively fragile underlying materials (low-k materials), etc. . . ). Therefore, some CMP systems incorporate a conditioning operation to condition or roughen the working surface of the polishing pad. The conditioning operation serves to increase a quantity and quality of asperities present on the working surface while also serving to dislodge slurry and CMP process residue. The conditioning operation is generally performed by applying a conditioning substrate to the working surface of the polishing pad.

Friction induced between the conditioning substrate and the working surface causes the conditioning to occur. It should be appreciated that the conditioning operation results are capable of influencing the associated CMP process results, e.g., wafer material removal rates and stability.

In view of the foregoing, there is a need for an apparatus and a method to effectively implement the conditioning operation. Furthermore, it is desirable to optimize an effectiveness and a longevity of the conditioning substrate used to perform the conditioning operation.

SUMMARY OF THE INVENTION

Broadly speaking, an invention is provided for conditioning a surface used to perform a chemical mechanical planarization (CMP) process. More specifically, the present invention provides an apparatus and an associated method for conditioning a working surface of a CMP pad. In one aspect of the present invention, the apparatus includes oscillation mechanics configured to oscillate a conditioning substrate in contact with the working surface of the CMP pad. An associated method is also provided for implementing oscillatory motion of the conditioning substrate when conditioning the working surface of the CMP pad during performance of the CMP process. In another aspect of the present invention, the apparatus includes a conditioning substrate backing that is configured to apply a differential pressure distribution to the conditioning substrate. The differential pressure distribution is transferred through the conditioning substrate to the working surface of the CMP pad. An associated method is also provided for implementing the differential pressure distribution when conditioning the working surface of the CMP pad during performance of the CMP process.

In one embodiment, a conditioning apparatus for use in a CMP system is disclosed. The conditioning apparatus includes a conditioning substrate, a holder configured to hold the conditioning substrate, and a shaft connected to the holder. The conditioning apparatus further includes rotation mechanics and oscillation mechanics. The rotation mechanics are capable of rotating the shaft. Rotation of the shaft in turn causes the holder and the conditioning substrate to also be rotated. The oscillation mechanics are capable of moving a position of the shaft within a region defined by a peripheral boundary. The peripheral boundary is less than and within an outer periphery of the conditioning substrate.

In another embodiment, a method for conditioning a pad used to perform a CMP process is disclosed. The method includes rotating a conditioning substrate about a centroid of the conditioning substrate. The method also includes applying the conditioning substrate to a moving CMP pad. The method further includes oscillating the conditioning substrate about the centroid of the conditioning substrate. Each of the rotating, applying, and oscillating operations are performed simultaneously.

In another embodiment, a conditioning apparatus for use in a CMP system is disclosed. The conditioning apparatus includes a conditioning substrate having an active side and a backside. A conditioning substrate backing is also included in the conditioning apparatus. The conditioning substrate backing defines a differential pressure distribution that is capable of being applied to the backside of the conditioning substrate.

In another embodiment, a method for conditioning a pad used to perform a CMP process is disclosed. The method includes establishing a differential pressure distribution over a surface of the conditioning substrate. The method further includes rotating the conditioning substrate and applying the conditioning substrate surface having the differential pressure distribution to a moving CMP pad.

Other aspects and advantages of the invention will become more apparent from the following detailed description, taken in conjunction with the accompanying drawings, illustrating by way of example the present invention.

BRIEF DESCRIPTION OF THE DRAWINGS

The invention, together with further advantages thereof, may best be understood by reference to the following description taken in conjunction with the accompanying drawings in which.

DETAILED DESCRIPTION

Broadly speaking, an apparatus and an associated method are provided for conditioning a surface used to perform a chemical mechanical planarization (CMP) process. More specifically, the present invention provides an apparatus and an associated method for conditioning a working surface of a CMP pad. In one aspect of the present invention, the apparatus includes oscillation mechanics configured to oscillate a conditioning substrate in contact with the working surface of the CMP pad. An associated method is also provided for implementing oscillatory motion of the conditioning substrate when conditioning the working surface of the CMP pad during performance of the CMP process. In another aspect of the present invention, the apparatus includes a conditioning substrate backing that is configured to apply a differential pressure distribution to the conditioning substrate. The differential pressure distribution is transferred through the conditioning substrate to the working surface of the CMP pad. An associated method is also provided for implementing the differential pressure distribution when conditioning the working surface of the CMP pad during performance of the CMP process.

In the following description, numerous specific details are set forth in order to provide a thorough understanding of the present invention. It will be apparent, however, to one skilled in the art that the present invention may be practiced without some or all of these specific details. In other instances, well known process operations have not been described in detail in order not to unnecessarily obscure the present invention.

Figure 1A:
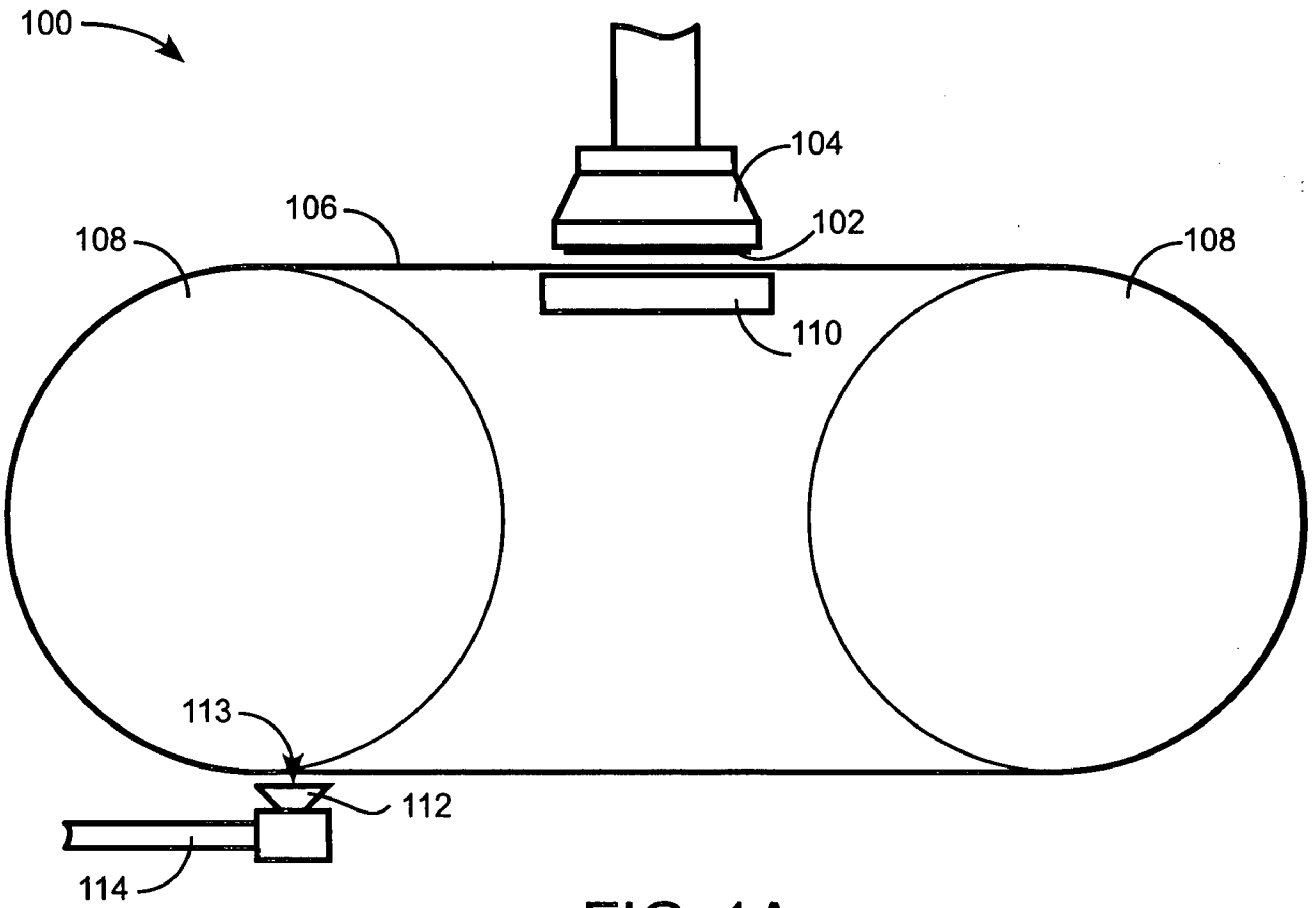
FIG. 1A shows a linear CMP processing system, in accordance with one embodiment of the present invention.

FIG. 1A shows a linear CMP processing system 100, in accordance with one embodiment of the present invention. As used herein, the linear CMP processing system 100 includes processing systems known as belt platen modules, belt roller assemblies, linear planarization tables, and any similar processing system implementing a linear belt for CMP processing of 200 millimeter (mm), 300 mm, or any size wafer or substrate. With reference to FIG. 1A, the linear CMP processing system 100 includes a wafer carrier 104 configured to receive, securely hold, and rotate a wafer 102. The wafer carrier 104 is disposed above a linear CMP processing pad ("linear pad") 106 at a location opposite a platen 110. The linear pad 106 is wrapped about a pair of drums 108. During operation, the pair of drums 108 rotate causing the linear pad 106 to traverse the platen 110. As the linear pad 106 traverses the platen 110, the wafer carrier 104 rotates and applies the wafer 102 to contact the linear pad 106. The platen 110 serves as a stable platform for resisting a downward force applied from the wafer carrier 104 through both the wafer 102 and the linear pad 106. Chemical and mechanical interactions at the contact interface between the wafer 102 and the linear pad 106 serve to effect the CMP process.

Various abrasives, chemistries, and fluids are combined to form a slurry which is applied to the linear pad 106 prior to traversing beneath the wafer 102. The slurry can become trapped in low-lying and/or porous regions of the linear pad 106. Additionally, CMP process residue from the chemical and mechanical interactions at the contact interface between the wafer 102 and the linear pad 106 can become trapped in low-lying and/or porous regions of the linear pad 106. Therefore, it is desirable to condition the linear pad 106 prior to repeating a traversal beneath the wafer 102. In following, a conditioner positioning arm 114, a conditioning substrate holder 112, and a conditioning substrate 113 are provided for conditioning the linear pad 106. The conditioning substrate 113 is disposed to be applied to a working surface of the linear pad 106. The working surface of the linear pad 106 is defined as the surface of the linear pad 106 which contacts the wafer 102. Contact between the conditioning substrate 113 and the working surface serves to dislodge and remove trapped slurry and CMP process residue. The conditioning substrate 113 can be disposed to contact the working surface at a variety of locations (e.g., above the drums 108 or below the drums 108). Regardless of where the conditioning substrate 113 is disposed, however, it is necessary that the conditioning substrate 113 be applied to the working surface in a substantially uniform manner across the linear pad 106, thus providing substantially uniform interface conditions across the working surface contacting the wafer 102.

Figure 1B:
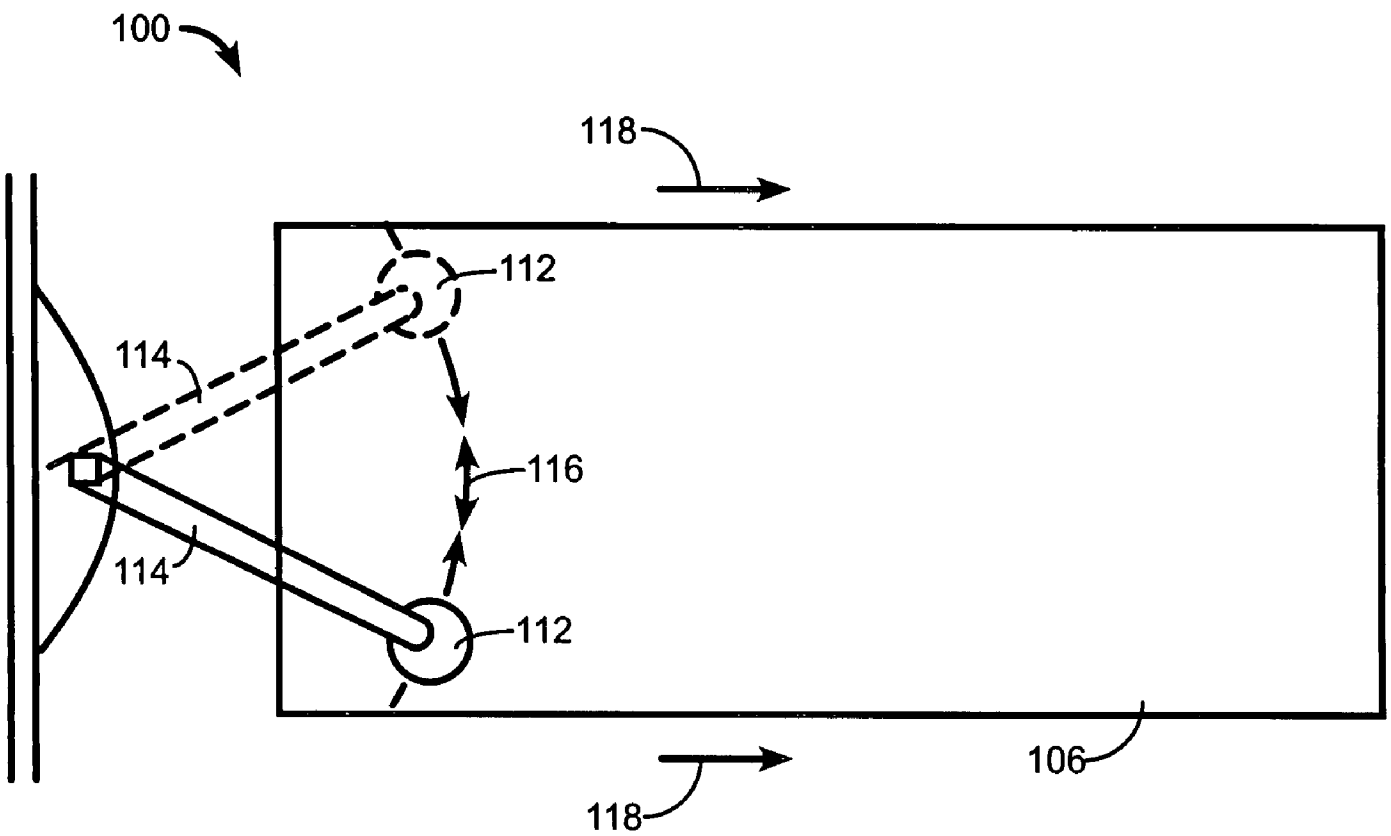
FIG. 1B shows a bottom view of the linear CMP processing system of FIG. 1A illustrating a radial sweeping motion of the conditioning substrate (not shown) across the linear pad.

FIG. 1B shows a bottom view of the linear CMP processing system 100 of FIG. 1A illustrating a radial sweeping motion 116 of the conditioning substrate 113 (not shown) across the linear pad 106. The conditioner positioning arm 114 applies the conditioning substrate 113, secured to the conditioning substrate holder 112, against the working surface of the linear pad 106. The conditioner positioning arm 114 moves the conditioning substrate 113 back and forth across the working surface in the radial sweeping motion 116 to ensure conditioning of the entire working surface. The conditioner positioning arm 114 and conditioning substrate holder 112 are shown in solid and broken lines to illustrate movement of the conditioning substrate 113 across the entire width of the working surface. During operation of the linear CMP processing system 100, the linear pad 106 travels in a direction indicated by arrows 118, by way of example. A combination of moving the linear pad 106 and moving the conditioning substrate 113 with the radial sweeping motion 116 results in conditioning of essentially the entire working surface of the linear pad 106.

Figure 1C:
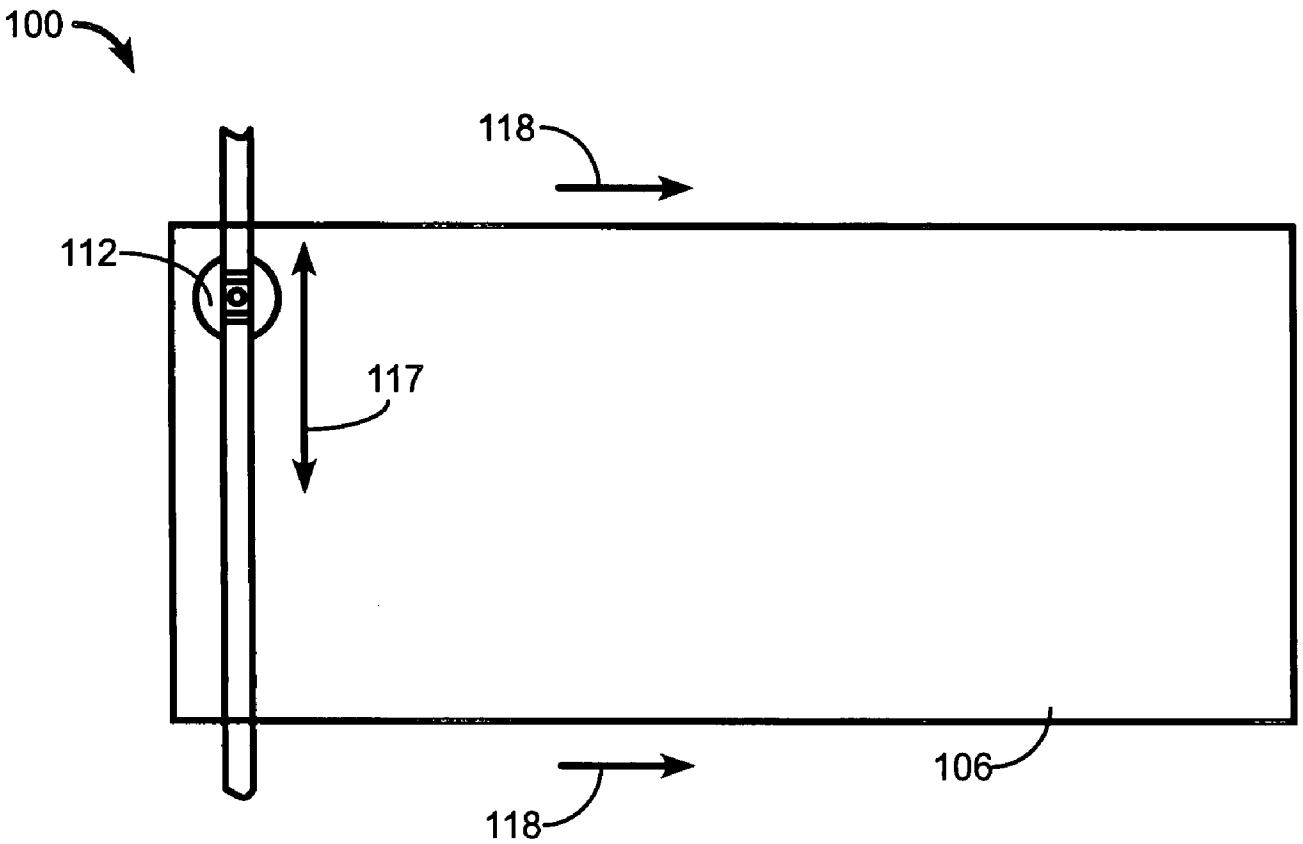
FIG. 1C shows a bottom view of the linear CMP processing system of FIG. 1A illustrating a linear sweeping motion of the conditioning substrate (not shown) across the linear pad.

FIG. 1C shows a bottom view of the linear CMP processing system 100 of FIG. 1A illustrating a linear sweeping motion 117 of the conditioning substrate 113 (not shown) across the linear pad 106. The conditioner positioning arm 114 applies the conditioning substrate 113, secured to the conditioning substrate holder 112, against the working surface of the linear pad 106. The conditioner positioning arm 114 moves the conditioning substrate 113 back and forth across the working surface in the linear sweeping motion 117 to ensure conditioning of the entire working surface. In manner similar to that previously described with respect to FIG. 1B, a combination of moving the linear pad 106 and moving the conditioning substrate 113 with the linear sweeping motion 117 results in conditioning of essentially the entire working surface of the linear pad 106.

Figure 2B:
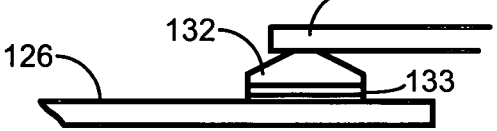
FIG. 2B shows a side view of an interface between a conditioning substrate and the working surface of the rotary pad as presented in FIG. 2A.
Figure 2A:
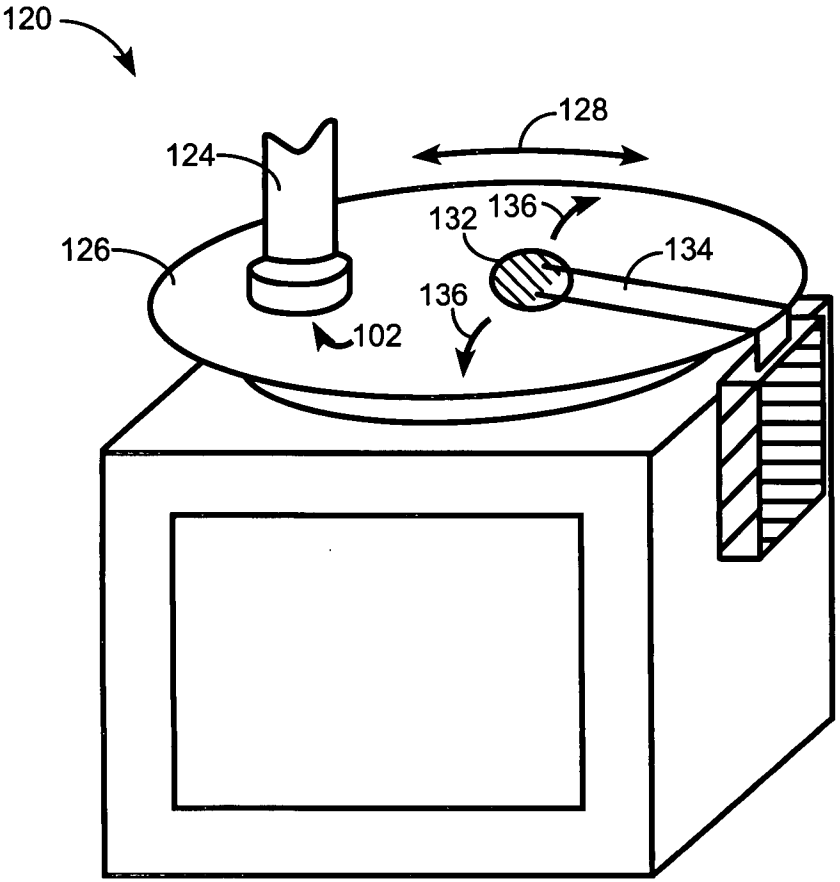
FIG. 2A shows a rotary CMP processing system, in accordance with one embodiment of the present invention.

FIG. 2A shows a rotary CMP processing system 120, in accordance with one embodiment of the present invention. As used herein, the rotary CMP processing system 120 includes processing systems known as rotary buff modules, rotary planarization tables, and any similar processing system implementing a rotary or generally circular processing surface for CMP processing of 200 mm, 300 mm, or any size wafer or substrate. With reference to FIG. 2A, the rotary CMP processing system 120 includes a wafer carrier 124 configured to receive, securely hold, and rotate the wafer 102. The wafer carrier 124 is further configured to apply the wafer 102 against a rotary CMP processing pad ("rotary pad") 126. As with the linear pad previously discussed, the rotary pad 126 also has a working surface configured to contact the wafer 102. During operation, the rotary pad 126 rotates, as indicated by an arrow 128, causing the working surface of the rotary pad 126 to traverse beneath the wafer 102. Thus, during operation the wafer 102 is exposed to forces resulting from both the rotation of the wafer 102 and the rotation of the rotary pad 126. Chemical and mechanical interactions at the contact interface between the wafer 102 and the rotary pad 106 serve to effect the CMP process.

As with the linear CMP processing system 100, various abrasives, chemistries, and fluids are combined to form a slurry which is applied to the rotary pad 126 prior to traversing beneath the wafer 102. Slurry and CMP process residue can also become trapped within low-lying and/or porous regions of the rotary pad 126. Therefore, it is desirable to condition the rotary pad 126 prior to repeating a traversal beneath the wafer 102. In following, a conditioner positioning arm 134, a conditioning substrate holder 132, and a conditioning substrate 133 (not shown) are provided for conditioning the rotary pad 126. The conditioning substrate 133 is disposed to be applied to the working surface of the rotary pad 126. As with the linear pad 106, contact between the conditioning substrate 133 and the working surface of the rotary pad 126 serves to dislodge and remove trapped slurry and CMP process residue. To achieve conditioning of the entire working surface to which the wafer 102 is exposed, the conditioning substrate 133 is moved back and forth across the working surface in a radial sweeping motion 136. It should be appreciated that movement of the conditioning substrate 133 back and forth across the working surface is not limited to the radial sweeping motion 136. Other directions of conditioning substrate 133 travel across the working surface are acceptable so long as essentially the entire working surface is conditioned.

FIG. 2B shows a side view of an interface between a conditioning substrate 133 and the working surface of the rotary pad 126 as presented in FIG. 2A. The conditioning substrate 133 is secured to the conditioning substrate holder 132 which is in turn attached to the conditioner positioning arm 134.

Figure 3:
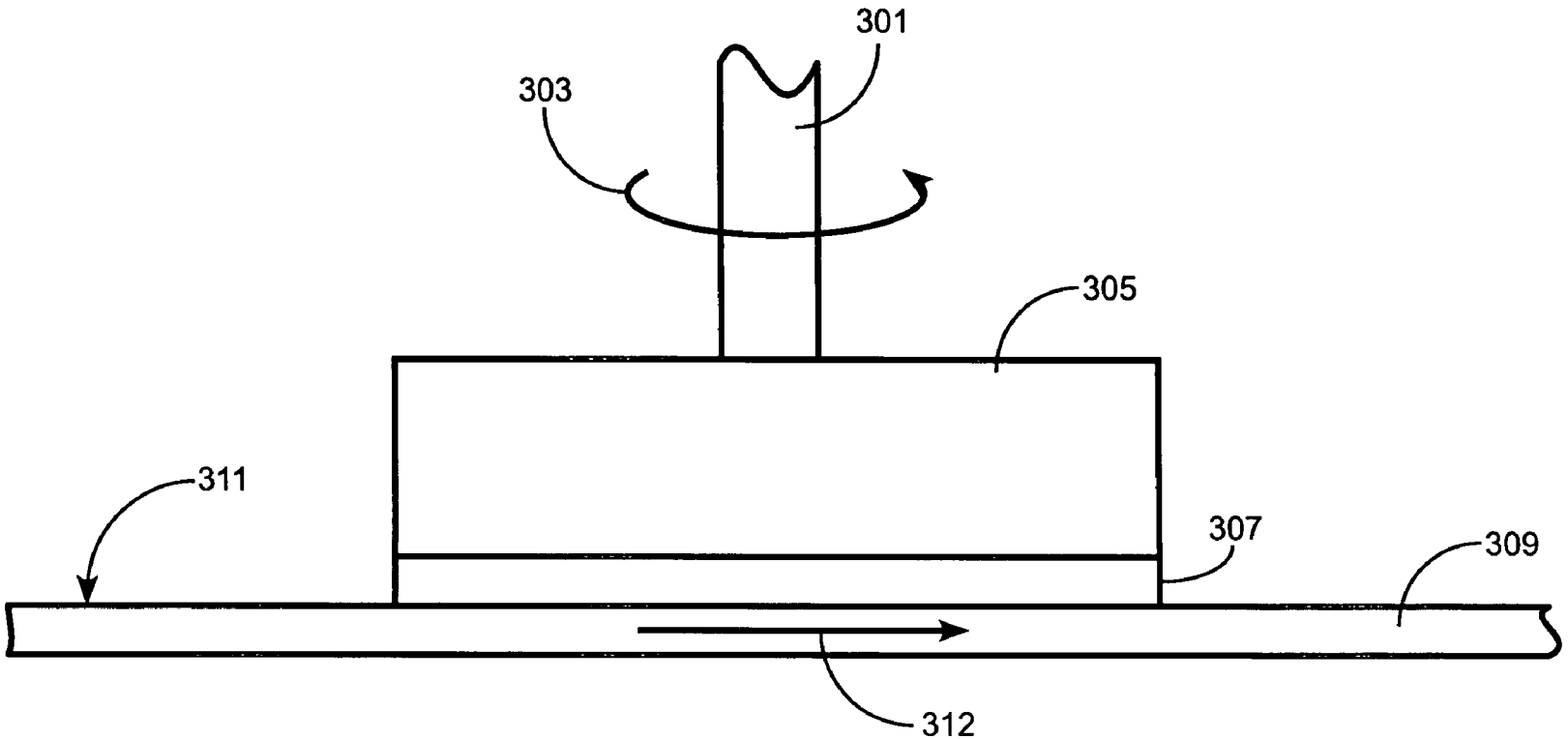
FIG. 3 shows a side view of a conditioning substrate in contact with a working surface of a CMP pad, in accordance with one embodiment of the present invention.

FIG. 3 shows a side view of a conditioning substrate 307 in contact with a working surface 311 of a CMP pad 309, in accordance with one embodiment of the present invention. The conditioning substrate 307 is defined to have an active side and a backside. The active side of the conditioning substrate is in contact with the working surface 311. The backside of the conditioning substrate 307 is in contact with a conditioning substrate holder 305. The conditioning substrate 307 is secured to the conditioning substrate holder 305, which is secured to a conditioner shaft 301. During the CMP process, the CMP pad 309 is in motion as indicated by an arrow 312, and the conditioner shaft 301 is rotating as indicated by an arrow 303. It should be appreciated that the direction of movement of the CMP pad 309 and rotation of the conditioner shaft 301 is not limited to that indicated by arrows 312 and 303, respectively. In various embodiments, the CMP pad 309 and conditioner shaft 301 can be configured to travel in multiple directions and can also be optionally configured to incorporate periodic changes in direction of travel. Furthermore, during the CMP process, the conditioning substrate 307 sweeps across the CMP pad 309 in a direction that is generally perpendicular to the direction of travel of the CMP pad 309. As previously discussed, the specific sweeping motion of the conditioning substrate 307 across the CMP pad 309 can vary from a radial sweeping motion to a linear sweeping motion, depending on a type of conditioner positioning system utilized.

Figure 4:
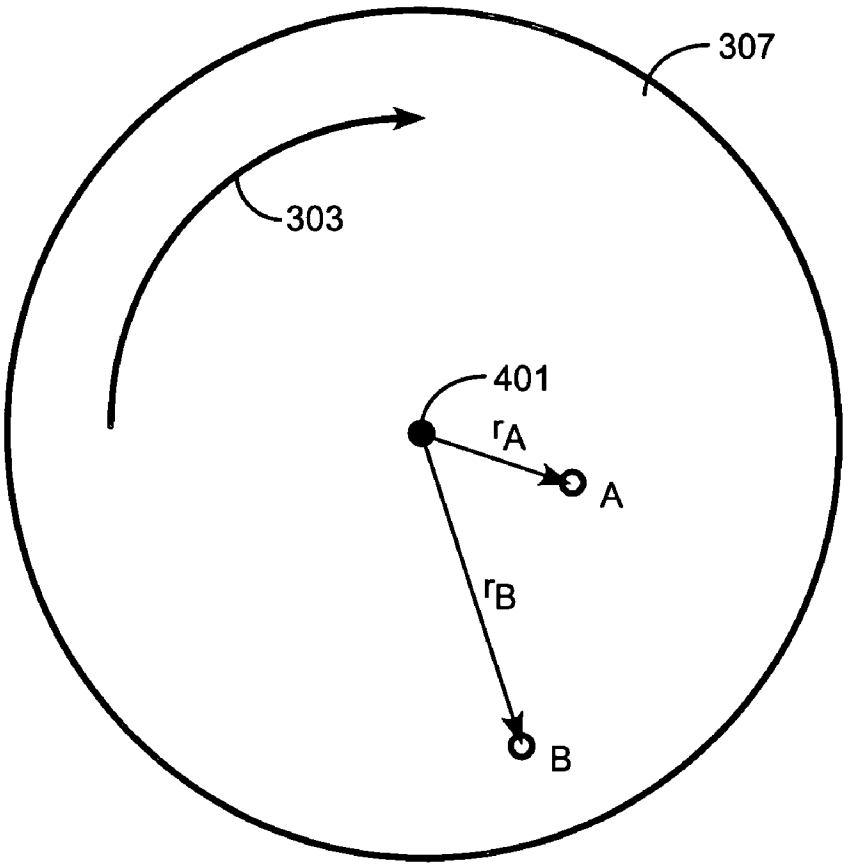
FIG. 4 shows a bottom view of the conditioning substrate, in accordance with one embodiment of the present invention.

FIG. 4 shows a bottom view of the conditioning substrate 307, in accordance with one embodiment of the present invention. The conditioning substrate 307 rotates about a central axis 401, in the direction indicated by the arrow 303. For discussion purposes, two points, A and B, are identified on the bottom of the conditioning substrate 307. The points A and B are at radial distances $r_A$ and $r_B$, respectively, from the central axis 401. Since $r_B$ is greater that $r_A$, point B will travel a greater distance about the central axis 401 than point A, during each revolution of the conditioning substrate 307. During the CMP process, a total distance traveled by each of points A and B relative to the working surface 311 of the CMP pad 309 is represented as a combination of a distance traveled due to rotation of the conditioning substrate 307, a distance traveled due to sweeping of the conditioning substrate 307 across the CMP pad 309, and an effective distance traveled due to movement of the CMP pad 309. It should be appreciated that the actual distance traveled by a given point on the conditioning substrate 307 relative to the CMP pad 309 can be represented as a function defined by kinematic relationships between: 1) rotation of the given point about the central axis 401, 2) movement of the central axis 401, and 3) movement of the CMP pad 309.

Conditioning work performed by a given point on the conditioning substrate 307 is directly proportional to the distance traveled by the given point on the conditioning substrate 307, relative to the CMP pad 309. Therefore, increasing the distance traveled by a given point on the conditioning substrate 307, relative to the CMP pad 309, will increase the conditioning work performed by the given point. To this end, the present invention provides for increasing the distance traveled by a given point on the conditioning substrate 307 through oscillation of the conditioning substrate 307. Oscillation of the conditioning substrate 307 introduces a fourth source of motion to be included in the function defined by kinematic relationships, as previously discussed. Oscillation of the conditioning substrate 307 can be achieved in a number of ways. In general, however, oscillation is achieved by moving the conditioning substrate 307 about a centroid of the conditioning substrate 307. The centroid represents a point from which all distances to an outer periphery of the conditioning substrate 307 sum to zero. During oscillation, the conditioner shaft 301 is moved within an outer boundary defined within a periphery of the conditioning substrate 307.

Figure 5A:
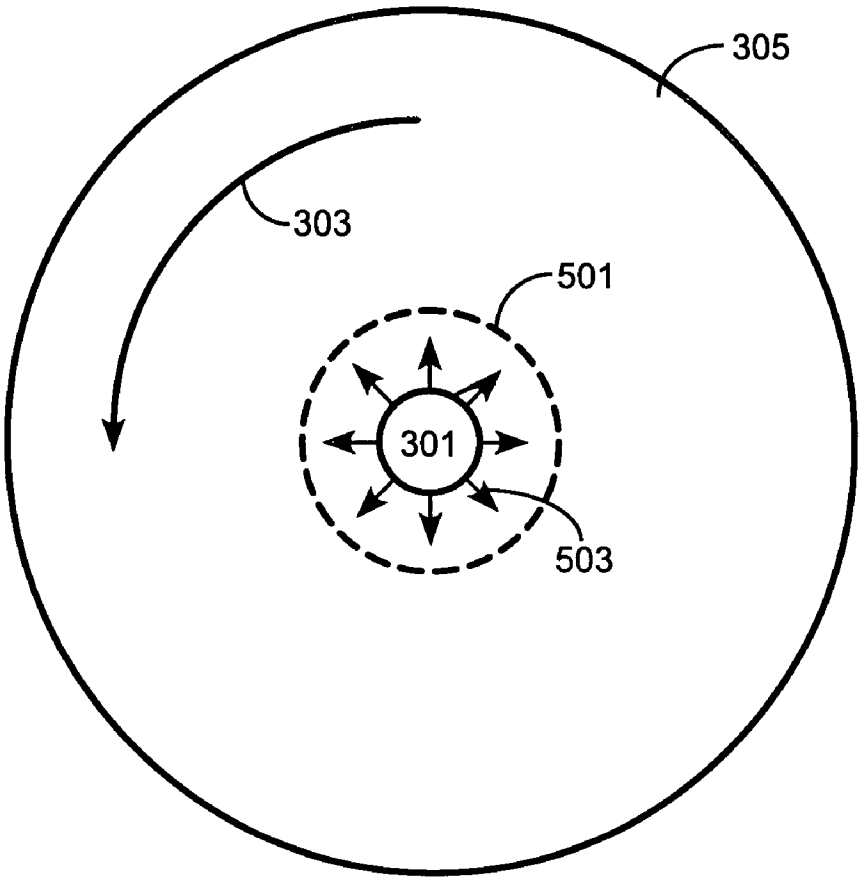
FIG. 5A shows a top view of the conditioning substrate holder illustrating an oscillation capability, in accordance with one embodiment of the present invention.

FIG. 5A shows a top view of the conditioning substrate holder 305 illustrating an oscillation capability, in accordance with one embodiment of the present invention. As previously discussed with respect to FIG. 3, the conditioning substrate holder 305 is connected to the conditioner shaft 301. As the conditioner shaft 301 is rotated, the conditioning substrate holder 305 is also rotated, as indicated by the arrow 303. Oscillation of the conditioning substrate 307 via the conditioning substrate holder 305 is achieved by moving the conditioner shaft 301 in various oscillation directions 503 within an oscillation boundary 501. In one embodiment, the oscillation boundary 501 is represented as a circular boundary defined by a radius that is less than 10% of a radius defining the outer periphery of the conditioning substrate 307. It should be appreciated, however, that in other embodiments of the present invention the oscillation boundary 501 can be defined by a non-circular geometric shape (e.g., rectangular, triangular, etc. . . ). The oscillatory motion causes the conditioning substrate 307 to be moved about the centroid of the conditioning substrate 307 as defined prior to commencement of the oscillatory motion. Prior to oscillation, the centroid of the conditioning substrate 307 is coincident with a center of the oscillation boundary 501. It should be appreciated that the oscillation directions 503 are not limited to those exemplified in FIG. 5A. The oscillation directions 503 can vary from being random to following a specified pattern. In one embodiment, the oscillation pattern can be tuned to achieve a particular conditioning effect. The distance traveled by a given point on the conditioning substrate 307 due to oscillation, in a given period of time, is directly proportional to an oscillation rate. Therefore, an increase in the rate of oscillation will cause an corresponding increase in the conditioning work performed by the conditioning substrate 307, vice versa.

Figure 5B:
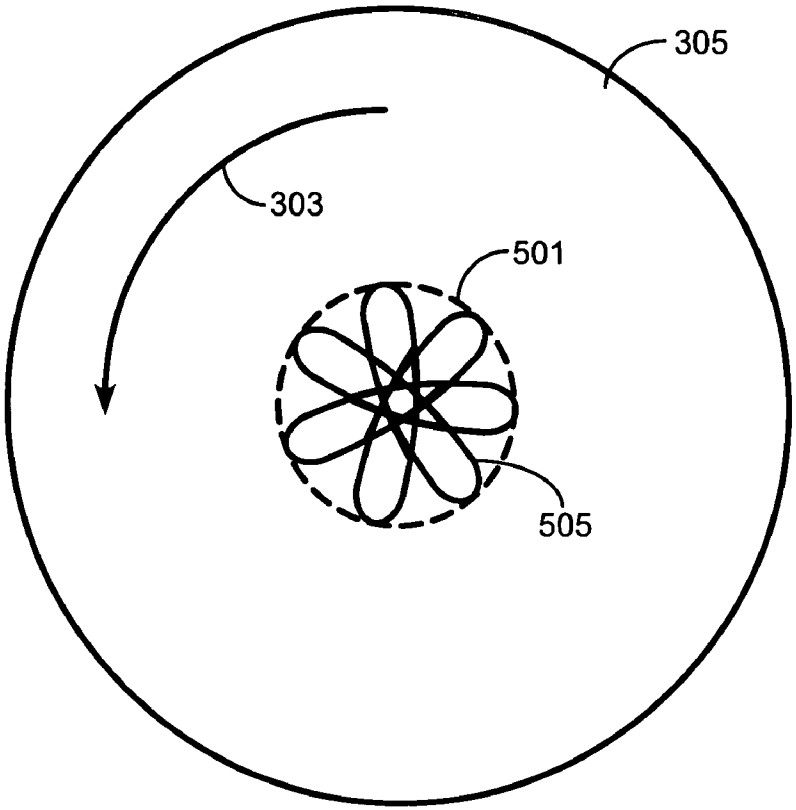
FIGS. 5B and 5C show a top view of the conditioning substrate holder illustrating an orbital oscillation pattern and a linear oscillation pattern, respectively, in accordance with various embodiments of the present invention.
Figure 5C:
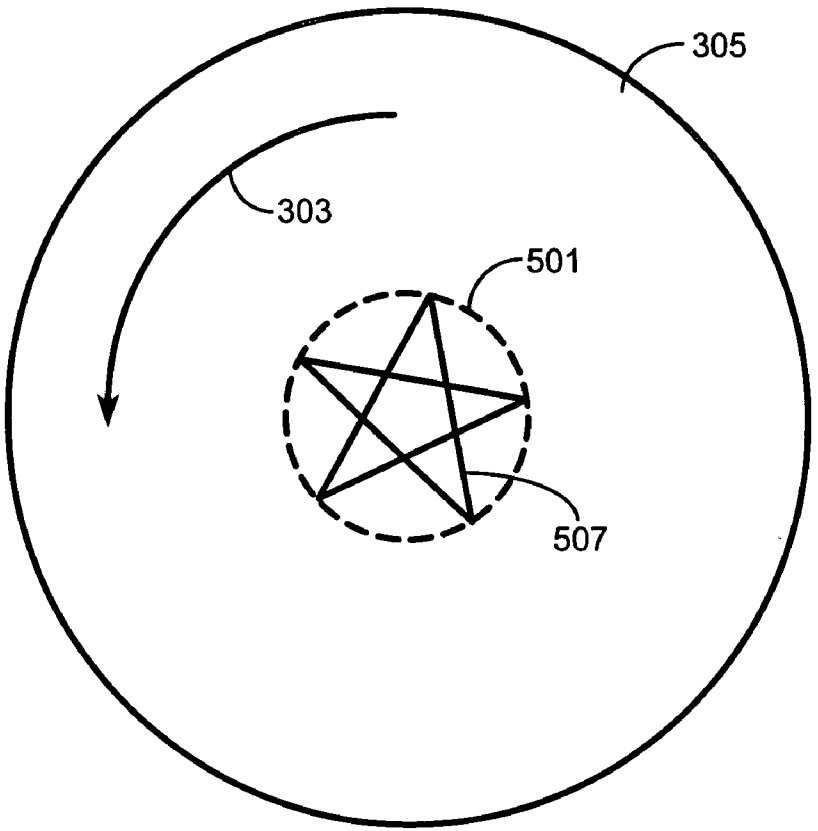

FIGS. 5B and 5C show a top view of the conditioning substrate holder 305 illustrating an orbital oscillation pattern SOS and a linear oscillation pattern 507, respectively, in accordance with various embodiments of the present invention. In another embodiment of the present invention, a random oscillation pattern is utilized. Regardless of the particular oscillation pattern utilized, movement of the conditioner shaft 301 within the oscillation boundary 501 is performed in a substantially symmetric manner.

Figure 6:
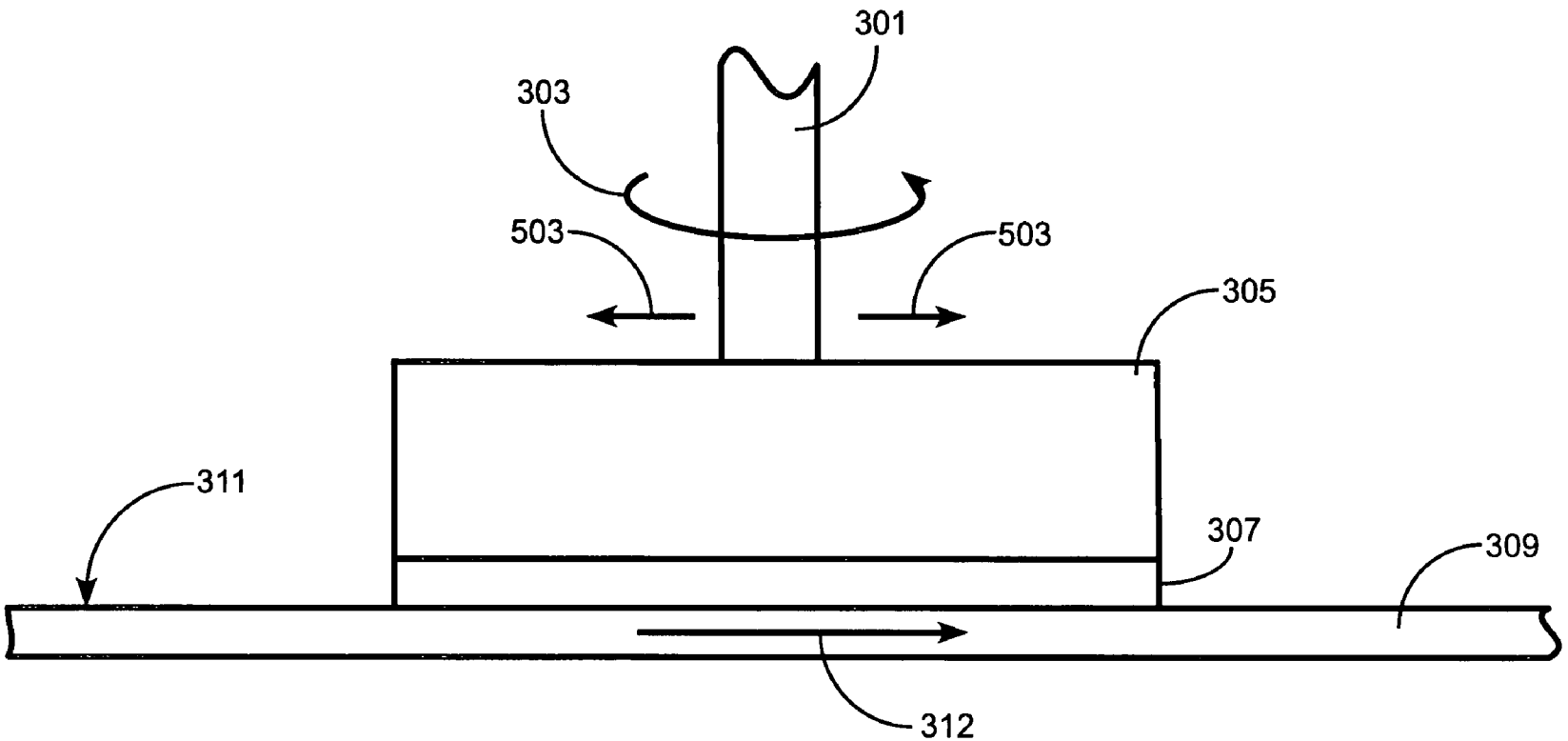
FIG. 6 shows a side view of the conditioning substrate in contact with the working surface of the CMP pad with inclusion of oscillatory motion, in accordance with one embodiment of the present invention.

FIG. 6 shows a side view of the conditioning substrate 307 in contact with the working surface 311 of the CMP pad 309 with inclusion of oscillatory motion, in accordance with one embodiment of the present invention. FIG. 6 is similar to FIG. 3 with the addition of the oscillatory motion as indicated by the oscillation directions 503. With the present invention, the actual distance traveled by a given point on the conditioning substrate 307 relative to the working surface 311 is represented as a function defined by kinematic relationships between: 1) rotation of the given point about the central axis 401 of the conditioning substrate 307, 2) movement of the conditioning substrate 307 across the CMP pad 309, 3) movement of the CMP pad 309, and 4) oscillation about the centroid of the conditioning substrate 307.

It should be appreciated that oscillation of the conditioning substrate 307 as supplied by the present invention provides a number of advantages. For example, increased movement of the conditioning substrate 307 in a larger variety of directions allows for more uniform wear of the conditioning substrate 307 and more uniform conditioning of the working surface 311 of the CMP pad 309. Also, the increased distance of travel by each point on the conditioning substrate 307 as a result of the oscillatory motion increases the conditioning work performed in each sweep of the conditioning substrate 307 across the CMP pad 309. Thus, oscillation of the conditioning substrate 307 provides for more efficient conditioning of the working surface 311 per sweep.

Figure 7:
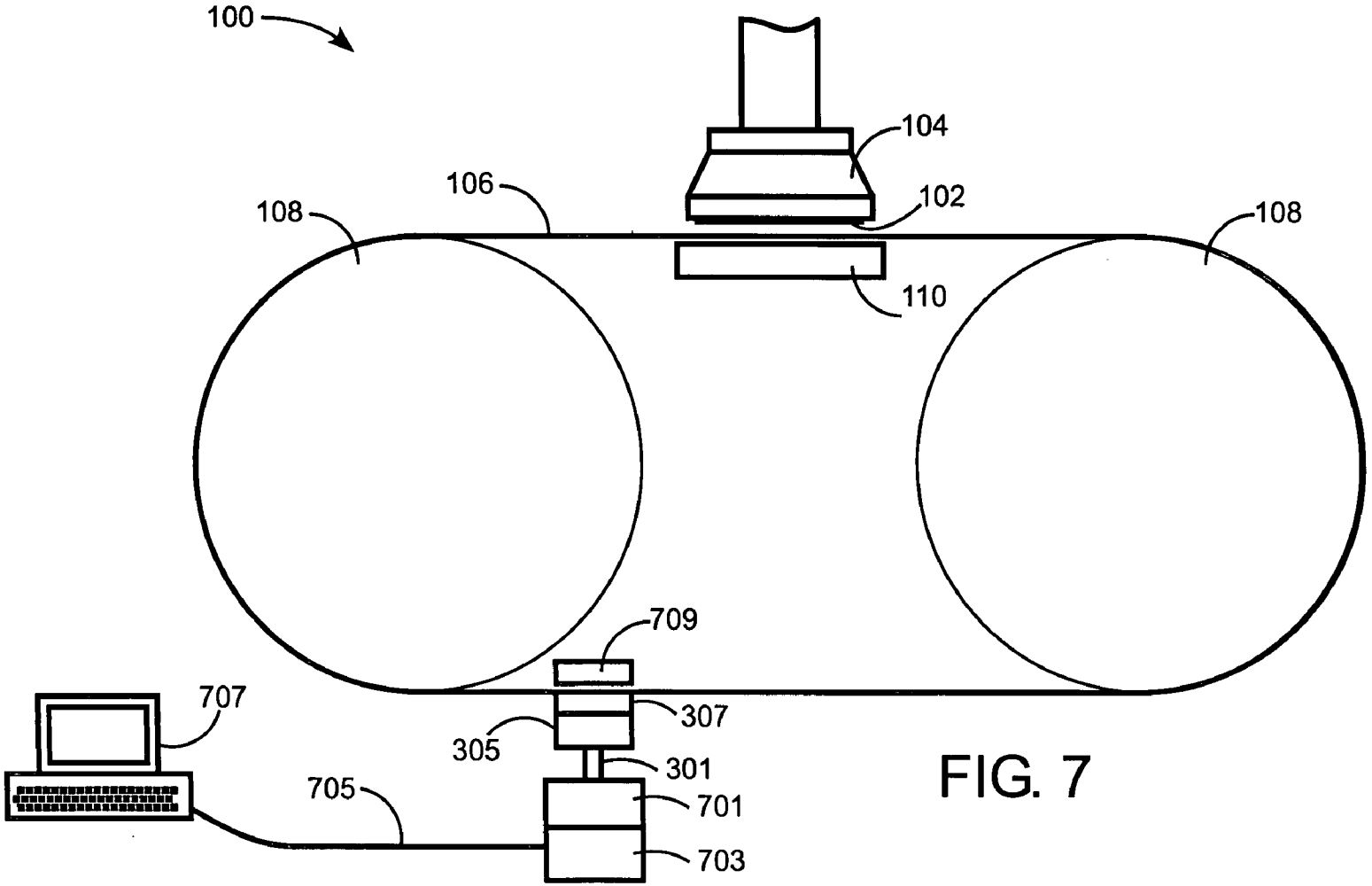
FIG. 7 shows the linear CMP processing system incorporating a conditioner system having oscillation capability, in accordance with one embodiment of the present invention.

FIG. 7 shows the linear CMP processing system 100 incorporating a conditioner system having oscillation capability, in accordance with one embodiment of the present invention. With exception of the conditioning system, the linear CMP processing system 100 is substantially similar to that described with respect to FIG. 1A. The conditioning system of FIG. 7 includes the conditioning substrate 307, the conditioning substrate holder 305, and the conditioner shaft 301, as previously discussed. The conditioning substrate 307 is disposed to be applied to the working surface of the linear pad 106. Contact between the conditioning substrate 307 and the working surface serves to dislodge and remove trapped slurry and CMP process residue. Furthermore, the conditioning substrate 307 can be disposed to contact the working surface at a variety of locations (e.g., above the drums 108 or below the drums 108). Additionally, in one embodiment a conditioning platen 709 can be disposed against a backside of the linear pad 106 opposite a location at which the conditioning substrate 307 contacts the working surface.

The conditioner shaft 301 is configured to be engaged by rotary mechanics, sweeping mechanics, and oscillation mechanics 701. The oscillation mechanics 701 are controlled by an oscillation controller 703 which is in communication with a computing system 707 through a communication link 705. The oscillation mechanics 701 are defined to oscillate the conditioner shaft 301 in accordance with control signals received from the oscillation controller 703. In one embodiment, the oscillation controller 703 can be programmed via the computing system 707 to exercise the oscillation mechanics 701 in a prescribed manner such that a particular oscillation pattern and duration is implemented.

It should be appreciated that the oscillation mechanics 701 and oscillation controller 703 of the present invention can be implemented in conjunction with a number of different conditioner positioning systems. For example, the oscillation mechanics 701 and oscillation controller 703 can be implemented in conjunction with either the linear sweeping motion (e.g. FIG. 1A) or the radial sweeping motion (e.g., FIG. 1B). Also, the oscillation mechanics 701 and oscillation controller 703 can be disposed in either physically contiguous locations (as shown in FIG. 7) or physical separate locations. For example, in one embodiment, the oscillation controller 703 is represented as an interface device within the computing system 707, and the communication link 705 is used to connected the oscillation controller 703 to the oscillation mechanics 701.

Figure 8:
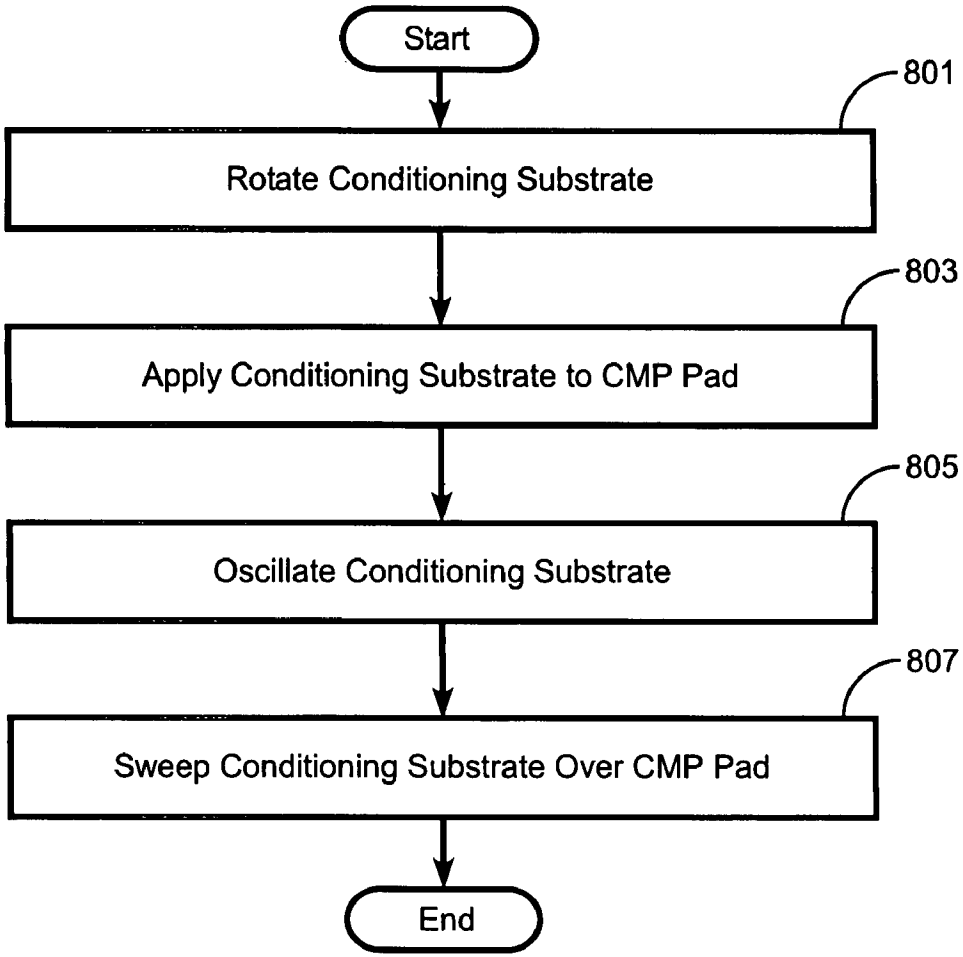
FIG. 8 is an illustration showing a flowchart of a method for conditioning a pad used to perform a CMP process with implementation of oscillatory motion, in accordance with one embodiment of the present invention.

FIG. 8 is an illustration showing a flowchart of a method for conditioning a pad used to perform a CMP process with implementation of oscillatory motion, in accordance with one embodiment of the present invention. The method includes an operation 801 in which a conditioning substrate is rotated about a centroid of the conditioning substrate. In an operation 803, the conditioning substrate is applied to a moving CMP pad. An operation 805 is provided for oscillating the conditioning substrate about the centroid of the conditioning substrate, wherein the centroid refers to the point occupied by the centroid prior to commencement of the oscillating. The oscillating is performed simultaneously with the rotating of the conditioning substrate. In one embodiment, the oscillating causes the conditioning substrate to be moved in a random pattern about the centroid of the conditioning substrate. In another embodiment, the oscillating causes the conditioning substrate to be moved in a specific pattern about the centroid of the conditioning substrate. For example, the specific pattern can be represented as either an orbital oscillation pattern or a linear oscillation pattern as previous described with respect to FIGS. 5B and 5C, respectively. Regardless of the specific pattern, however, the oscillating is constrained within a peripheral boundary that is less than and within an outer periphery of the conditioning substrate as defined prior to commencement of the oscillating. The method further includes an operation 807 for sweeping the conditioning substrate over the moving CMP pad in tandem with rotating the conditioning substrate and oscillating the conditioning substrate.

In addition to the distance traveled by each point of the conditioning substrate 307 relative to the working surface 311 of the CMP pad 309, the conditioning work is also influenced by an amount of force exerted by each point of the conditioning substrate 307 onto the working surface 311. The amount of force exerted by each point of the conditioning substrate 307 onto the working surface 311 is dependent upon a total force applied to the conditioning substrate 307, through the conditioner shaft 301, and a distribution of the total force over an interface between the conditioning substrate 307 and the working surface 311. The distribution of the total force over the interface between the conditioning substrate 307 and the working surface 311 serves to define a pressure distribution between the conditioning substrate 307 and the working surface 311. For purposes of discussion, the pressure distribution between the conditioning substrate 307 and the working surface 311 is referred to as a conditioning interface pressure distribution.

The present invention provides an apparatus and a method for establishing and controlling the conditioning interface pressure distribution. In some instances it is desirable to maintain a substantially homogeneous (i.e., uniform) conditioning interface pressure distribution. However, in other instances it is desirable to establish and control an optimal conditioning interface pressure distribution, wherein the optimal conditioning interface pressure distribution is not necessarily homogeneous. For example, the optimal conditioning interface pressure distribution can be established based on CMP results such as material removal rate, defects, dishing, or erosion performance, among others. The optimal conditioning interface pressure distribution can also be established based on other non-process methods such as scanning electron microscopy (SEM) imaging to determine size, distribution, geometry, and population of asperities on the working surface 311.

The conditioning interface pressure distribution can be used to improve conditioning efficiency and the lifetime of the conditioning substrate 307. For example, the conditioning interface pressure distribution can be controlled during conditioning operations to avoid uneven wear of the conditioning substrate 307, thus allowing each surface of the conditioning substrate 307 to contribute in a substantially uniform manner to the overall conditioning work. Additionally, the optimal conditioning interface pressure distribution may be adjusted during the lifetime of the conditioning substrate 307. By adjusting the conditioning interface pressure distribution to maintain near optimal performance during the lifetime of the conditioning substrate 307, the usable lifetime of the conditioning substrate 307 can be maximized. Thus, the present invention provides the advantage of extending the conditioning substrate 307 usable lifetime while providing a corresponding decrease in consumable cost.

Figure 9:
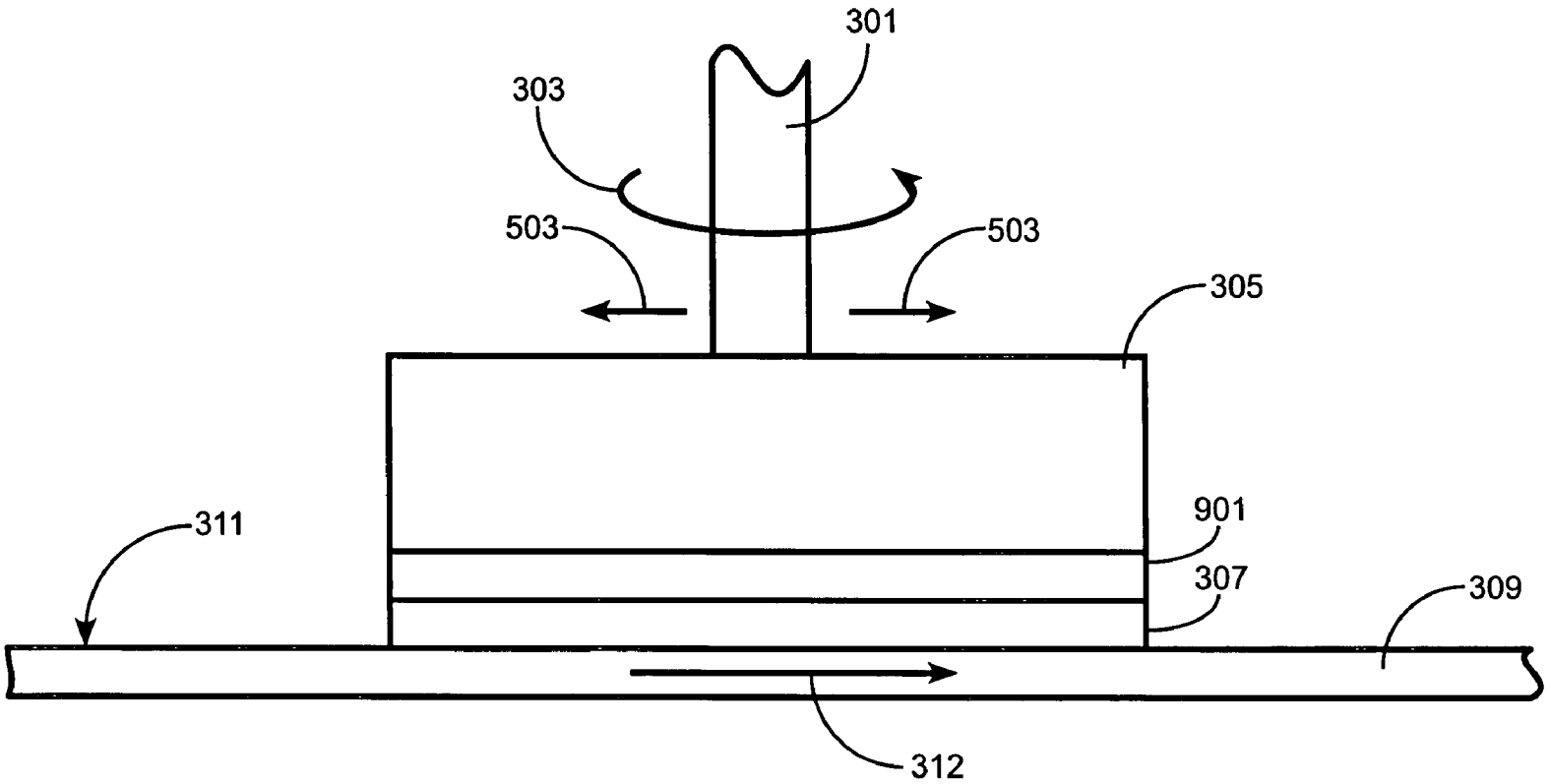
FIG. 9 shows a side view of the conditioning substrate in contact with the working surface of the CMP pad with inclusion of a conditioning substrate backing, in accordance with one embodiment of the present invention.

FIG. 9 shows a side view of the conditioning substrate 307 in contact with the working surface 311 of the CMP pad 309 with inclusion of a conditioning substrate backing 901, in accordance with one embodiment of the present invention. FIG. 9 is similar to FIG. 6 with the addition of the conditioning substrate backing 901. The conditioning substrate backing 901 is disposed between the conditioning substrate holder 305 and the conditioning substrate 307 such that the conditioning substrate backing 901 is in contact with the backside of the conditioning substrate 307. The conditioning substrate backing 901 serves to establish and control a differential pressure distribution which is transferred to the backside of the conditioning substrate 307, through the conditioning substrate 307, onto the working surface 311 during conditioning operations. In one embodiment, the conditioning substrate 307 is sufficiently thin such that pressure exerted from the conditioning substrate backing 901 can be easily transferred from the backside of the conditioning substrate 307 to the active side of the conditioning substrate 307 that is in contact with the working surface 311.

Figure 10A:
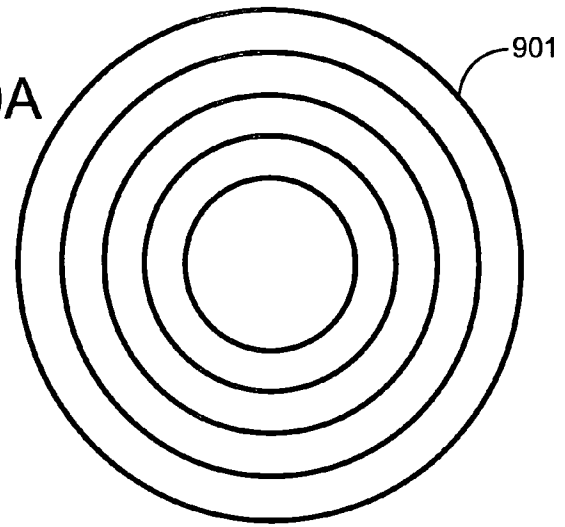
FIGS. 10A, 10B, 10C, and 10D show various conditioning interface pressure distribution patterns that can be established using the conditioning substrate backing, in accordance with various embodiments of the present invention.
Figure 10B:
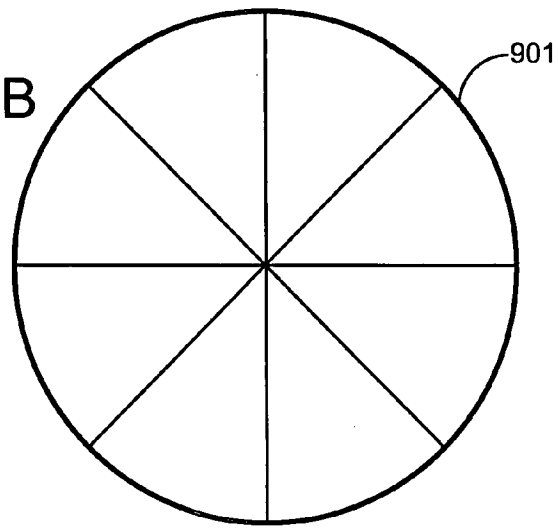
Figure 10C:
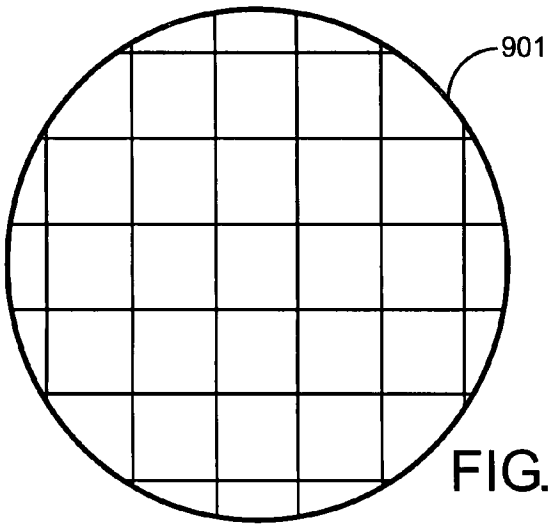
Figure 10D:
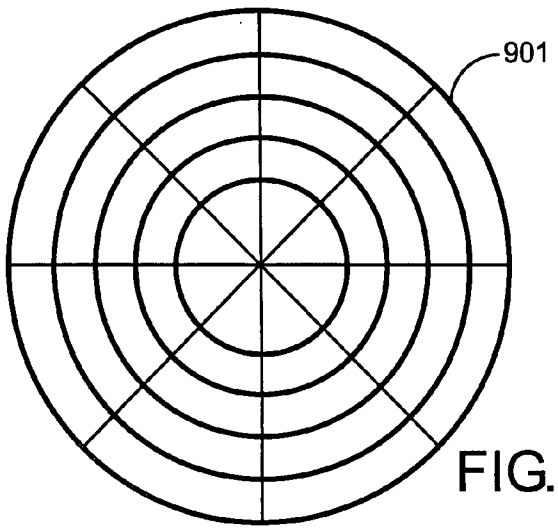

The conditioning substrate backing 901 can be configured to establish a conditioning interface pressure distribution in accordance with one of many different patterns. FIGS. 10A through 10B show various conditioning interface pressure distribution patterns that can be established using the conditioning substrate backing 901, in accordance with various embodiments of the present invention. In FIG. 10A, the conditioning interface pressure distribution pattern is represented as a number of concentric annular regions surrounding a central circular region. Each annular region and the central circular region can be controlled to exert a different pressure through the conditioning substrate 307 onto the working surface 311 of the CMP pad 309. Similarly, in FIG. 10B, the conditioning interface pressure distribution pattern is represented as a number of wedge shaped regions contiguous about a common center point. Again, each wedge shaped region can be controlled to exert a different pressure. FIG. 10D represents a combination of the annular and wedge shaped conditioning interface pressure distribution patterns shown in FIGS. 10A and 10B, respectively. Again, each cell in the pattern can be controlled to exert a different pressure through the conditioning substrate 307 onto the working surface 311 of the CMP pad 309. In FIG. 10C, the conditioning interface pressure distribution pattern is represented as a rectangular grid. It should be appreciated that the conditioning interface pressure distribution patterns depicted in FIGS. 10A through 10D are provided for exemplary purposes. Many additional patterns can be applied through benefit of the present invention to satisfy a variety of conditioning requirements.

Figure 11:
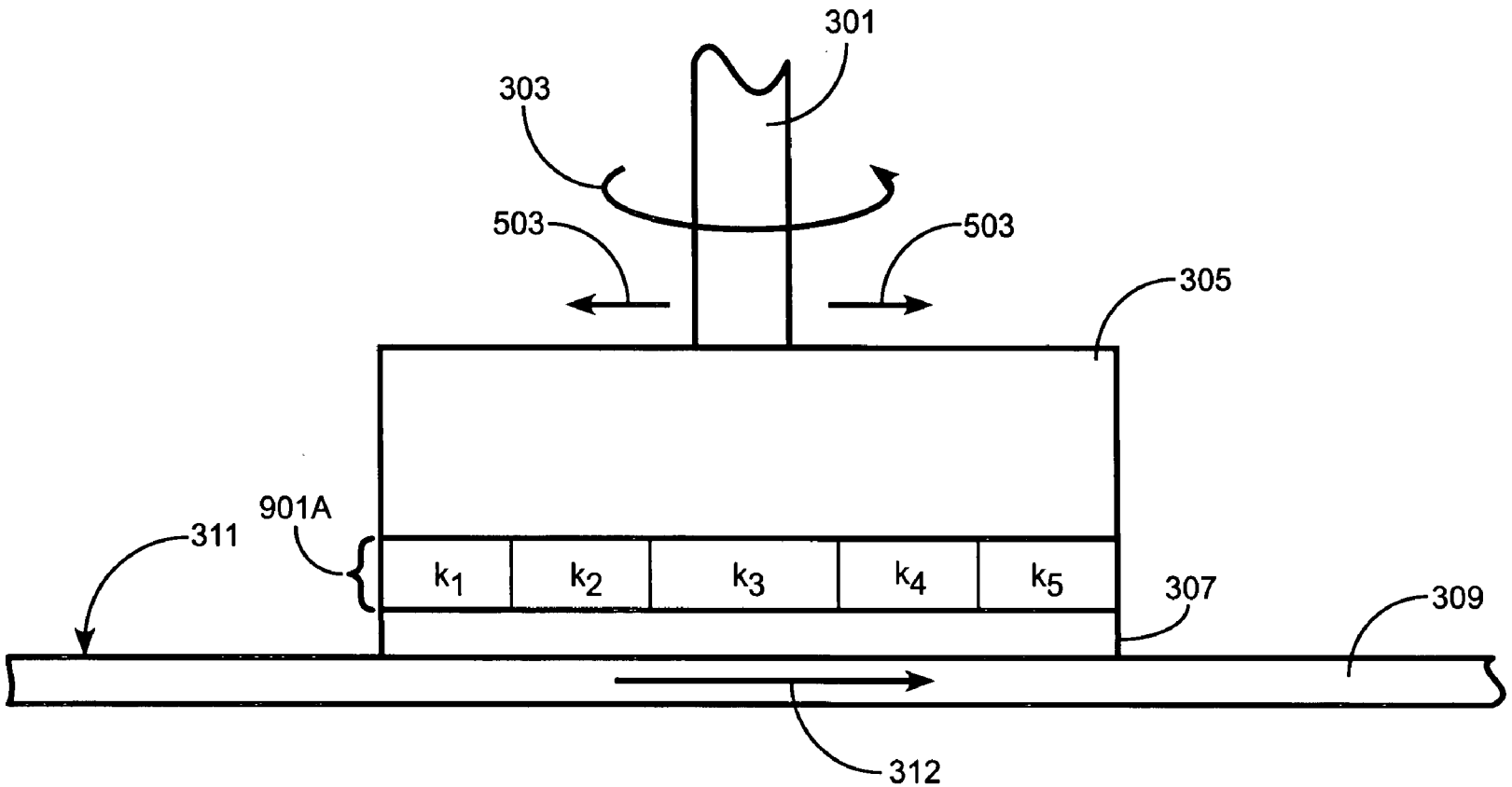
FIG. 11 shows a side view of the conditioning substrate in contact with the working surface of the CMP pad with inclusion of a solid conditioning substrate backing, in accordance with one embodiment of the present invention.

FIG. 11 shows a side view of the conditioning substrate 307 in contact with the working surface 311 of the CMP pad 309 with inclusion of a solid conditioning substrate backing 901A, in accordance with one embodiment of the present invention. Other than specifying the solid conditioning substrate backing 901A in place of the more general conditioning substrate backing 901, FIG. 11 is essentially the same as FIG. 9. The solid conditioning substrate backing 901A is capable of providing the necessary conditioning interface pressure distribution through arrangement of solid materials having varying spring constants (e.g., $k_1$ through $k_5$). It should be appreciated that solid material in the present context refers to a material that is self-contained (e.g., rubber, plastic, gel, metal, foam, etc . . . ). In one embodiment, a density of a common material can be adjusted to achieve the various spring constants. For example, if the solid conditioning substrate backing 901A is a rubber-type material, regions requiring larger spring constants (i.e., more stiffness) could be defined to have alternate material compositions for satisfying the larger spring constant requirements. In one embodiment, the rubber-type materials defining each region can be fused together to unify the solid conditioning substrate backing 901A into a single component. In other embodiments, the various spring constants required for the solid conditioning substrate backing 901A can be achieved by using different solid materials in each region. Thus, in this embodiment, the solid conditioning substrate backing 901A is represented as a combination of shaped materials arranged in an interlocking manner. In one embodiment, an adhesive can be used to secure the solid conditioning substrate backing 901A to the conditioning substrate holder 305. In another embodiment, an outer band or other containment device can be employed to confine the solid conditioning substrate backing 901A. In various embodiments, the conditioning substrate 307 can be secured to either the solid conditioning substrate backing 901A or the conditioning substrate holder 305. Regardless of the embodiment, however, the conditioning substrate 307 is secured to move with the conditioning substrate holder 305 in response to movement of the conditioner shaft 301.

Figure 12:
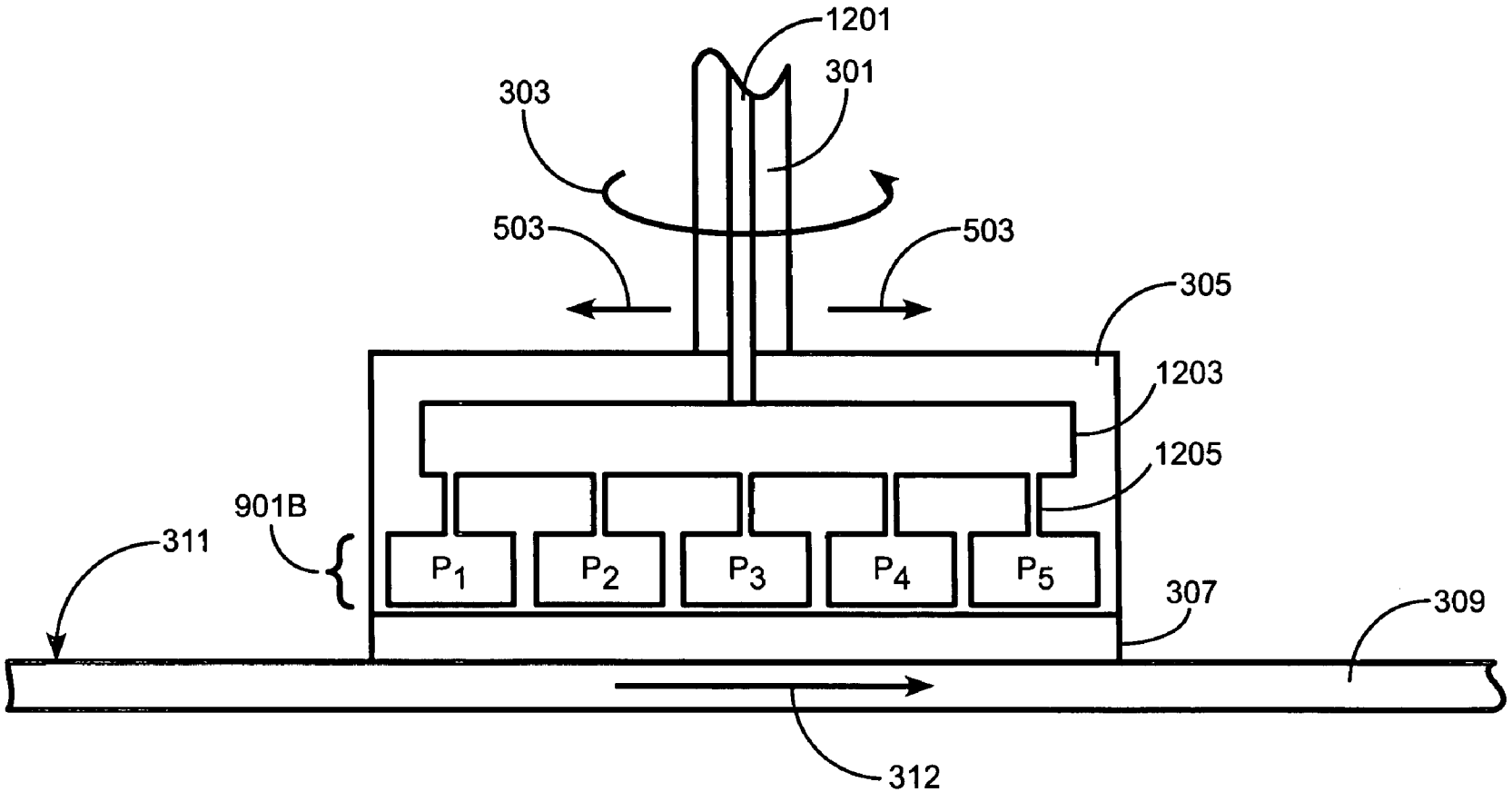
FIG. 12 shows a side view of the conditioning substrate in contact with the working surface of the CMP pad with inclusion of a fluid conditioning substrate backing, in accordance with one embodiment of the present invention.

FIG. 12 shows a side view of the conditioning substrate 307 in contact with the working surface 311 of the CMP pad 309 with inclusion of a fluid conditioning substrate backing 901B, in accordance with one embodiment of the present invention. Other than specifying the fluid conditioning substrate backing 901B in place of the more general conditioning substrate backing 901, FIG. 12 is essentially the same as FIG. 9. The fluid conditioning substrate backing 901B is capable of providing the necessary conditioning interface pressure distribution through use of multiple chambers (e.g., FIGS. 10A–10D) containing fluid at variable pressures (e.g., $p_1$ through $p_5$). In various embodiments, each of the multiple chambers can be self-contained or defined by an integral structure. Regardless of the particular chamber design, however, the fluid within each chamber is capable of exerting pressure on an adjacent portion of the conditioning substrate 307. In one embodiment, the conditioning substrate 307 also serves to contain the fluid within each chamber. In this embodiment, the fluid pressure within each chamber acts directly on the conditioning substrate 307. In another embodiment, each chamber is either lined with or established by a flexible membrane. In this embodiment, the fluid pressure within each chamber acts through the membrane on the conditioning substrate 307. It should be appreciated that any fluid (gas or liquid) that is chemically compatible with other interfacing materials and suitable for pressurization can be utilized in the present invention.

FIG. 12 represents an exemplary embodiment of the present invention provided for discussion purposes. It should be understood that the present invention is not limited to the physical structure of the fluid conditioning substrate backing 901B and associated fluid feed systems as illustrated in FIG. 12. The present invention also applies to any physical combination of fluid chambers and fluid feed systems capable of establishing and controlling a pressure distribution across the conditioning substrate 307.

With respect to FIG. 12, the fluid is provided through a fluid inlet 1201 in the conditioner shaft 301, to a fluid distribution manifold 1203 contained within the conditioning substrate holder 305. From the fluid distribution manifold 1203, the fluid is distributed to a number of fluid chambers (designated $p_1$ through $p_5$) through an associated fluid chamber supply pathway 1205. Each fluid chamber is separated by one or more partitions that serve to reduce pressure influences between adjacent fluid chambers, thus allowing the pressure distribution defined by the various fluid chambers to be more carefully controlled. In one embodiment, the fluid distribution manifold 1203, the fluid chamber supply pathways 1205, and the fluid chamber partitions are defined by rigid machined components. In another embodiment, the fluid distribution manifold 1203, the fluid chamber supply pathways 1205, and the fluid chambers are defined by a combination of rigid volumes, flexible bladders, and tubes. Regardless of the particular fluid distribution system, however, each fluid chamber ($p_1$ through $p_5$) is capable of exerting a specific, controlled pressure on an adjacent portion of the conditioning substrate 307. The conditioning substrate 307 is secured to move with the conditioning substrate holder 305 in response to movement of the conditioner shaft 301. In one embodiment, an outer ring surrounding the fluid conditioning substrate backing 901B is used to secure the conditioning substrate 307 to the conditioning substrate holder 305.

Figure 13:
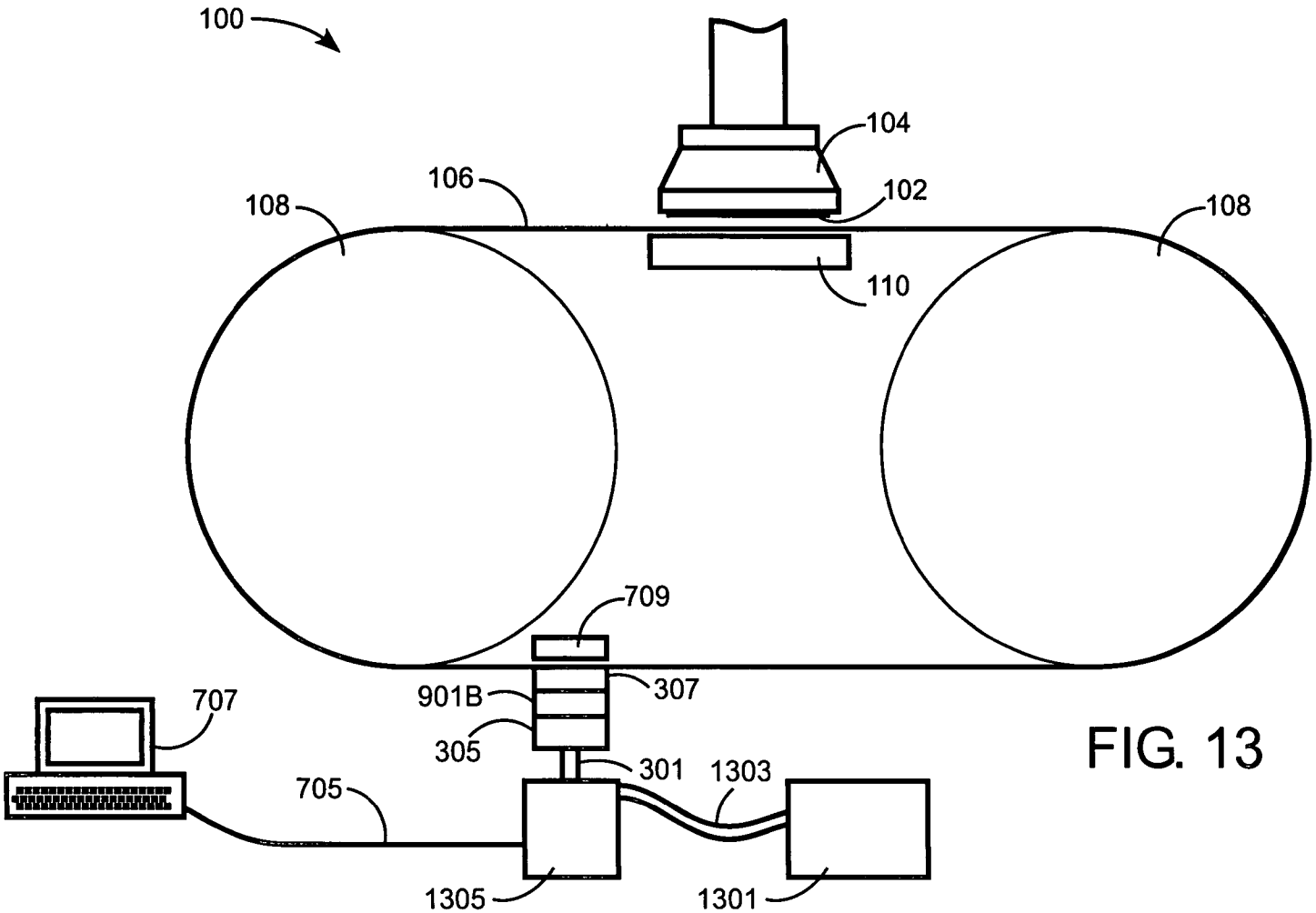
FIG. 13 shows the linear CMP processing system incorporating a conditioner system having a fluid conditioning substrate backing, in accordance with one embodiment of the present invention.

FIG. 13 shows the linear CMP processing system 100 incorporating a conditioner system having a fluid conditioning substrate backing 901B, in accordance with one embodiment of the present invention. With exception of the conditioning system, the linear CMP processing system 100 is substantially similar to that described with respect to FIG. 1A. The conditioning system of FIG. 13 includes the conditioning substrate 307, the fluid conditioning substrate backing 901B, the conditioning substrate holder 305, and the conditioner shaft 301, as previously discussed. The conditioning substrate 307 is disposed to be applied to the working surface of the linear pad 106. Contact between the conditioning substrate 307 and the working surface serves to dislodge and remove trapped slurry and CMP process residue. Furthermore, the conditioning substrate 307 can be disposed to contact the working surface at a variety of locations (e.g., above the drums 108 or below the drums 108). Additionally, in one embodiment the conditioning platen 709 can be disposed against a backside of the linear pad 106 opposite a location at which the conditioning substrate 307 contacts the working surface.

The conditioner shaft 301 is configured to be engaged by rotary mechanics, sweeping mechanics, and, in accordance with another aspect of the present invention, oscillation mechanics. The conditioner shaft 301 also serves as a pathway for supplying a fluid from a fluid pressure controller 1305 to the fluid conditioning substrate backing 901B. The fluid pressure controller 1305 is in fluid communication with a fluid source 1301 through a fluid supply 1303. The fluid pressure controller 1305 controls a pressure of the fluid supplied to the fluid conditioning substrate backing 901B. In one embodiment, the fluid conditioning substrate backing 901B is configured to transform a single fluid supply pressure into a desired conditioning interface pressure distribution. The fluid pressure controller 1305 is also in communication with a computing system 707 through a communication link 705. In one embodiment, the fluid pressure controller 1305 can be programmed via the computing system 707 to control the fluid supply pressure in a prescribed manner such that a particular conditioning interface pressure distribution is implemented. It should be appreciated that the conditioning substrate backing 901 of the present invention can be implemented in conjunction with a number of different conditioner positioning systems. For example, the conditioning substrate backing 901 can be implemented in conjunction with either the linear sweeping motion (e.g. FIG. 1A) or the radial sweeping motion (e.g., FIG. 1B).

Figure 14:
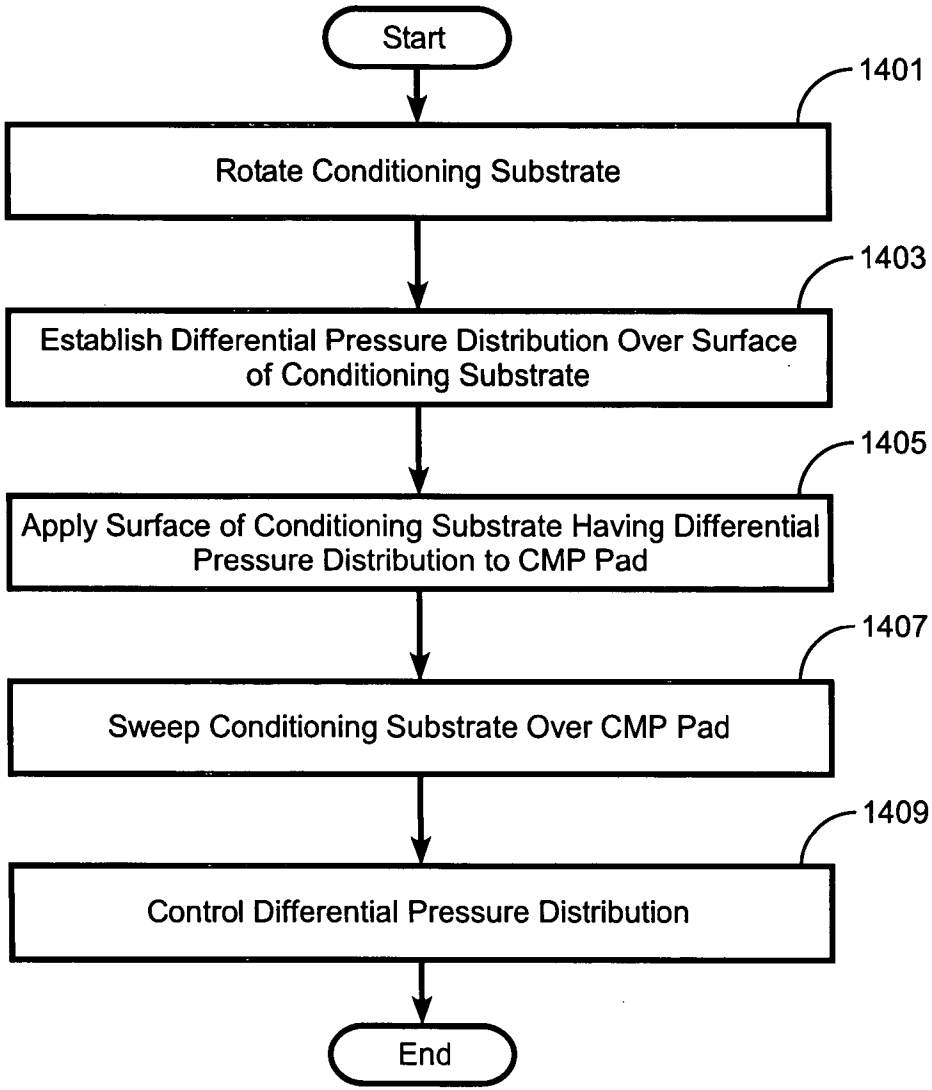
FIG. 14 is an illustration showing a flowchart of a method for conditioning a pad used to perform a CMP process, in accordance with one embodiment of the present invention.

FIG. 14 is an illustration showing a flowchart of a method for conditioning a pad used to perform a CMP process, in accordance with one embodiment of the present invention. The method includes an operation 1401 in which a conditioning substrate is rotated. In an operation 1403, a differential pressure distribution is established over a surface of the conditioning substrate. In one embodiment, establishing the differential pressure distribution is performed using a solid conditioning substrate backing in contact with the conditioning substrate as previously described with respect to FIG. 11. In another embodiment, establishing the differential pressure distribution is performed using a fluid conditioning substrate backing in contact with the conditioning substrate as previously described with respect to FIG. 12. The method continues with an operation 1405 in which the conditioning substrate surface having the differential pressure distribution is applied to a moving CMP pad. An operation 1407 is provided for sweeping the conditioning substrate having the differential pressure distribution over the moving CMP pad in tandem with rotating the conditioning substrate. The method further includes an operation 1409 for controlling the differential pressure distribution during the CMP process.

While this invention has been described in terms of several embodiments, it will be appreciated that those skilled in the art upon reading the preceding specifications and studying the drawings will realize various alterations, additions, permutations and equivalents thereof. It is therefore intended that the present invention includes all such alterations, additions, permutations, and equivalents as fall within the true spirit and scope of the invention.

What is claimed is:

1. A conditioning apparatus for use in a chemical mechanical planarization (CMP) system, comprising:

a conditioning substrate;

a holder configured to hold the conditioning substrate;

a shaft connected to the holder; and oscillation mechanics capable of moving the shaft in an oscillatory manner such that the conditioning substrate is moved about a centroid of the conditioning substrate, the oscillation mechanics further configured to move the shaft and conditioning substrate attached thereto in a random manner about the centroid of the conditioning substrate.

2. The conditioning apparatus for use in a CMP system as recited in claim 1, wherein the oscillation mechanics are configured to move the shaft and conditioning substrate attached thereto in a specific oscillation pattern about the centroid of the conditioning substrate.

3. The conditioning apparatus for use in a CMP system as recited in claim 2, wherein the specific oscillation pattern is represented as one of an orbital oscillation pattern and a linear oscillation pattern.

4. The conditioning apparatus for use in a CMP system as recited in claim 1, further comprising:

a positioning arm configured to engage the shaft, the positioning arm capable of sweeping the conditioning substrate over a working surface of a CMP pad in tandem with operation of the oscillation mechanics.

5. A conditioning apparatus for use in a chemical mechanical planarization (CMP) system, comprising:

a conditioning substrate having an active side and a backside;

a conditioning substrate backing capable of defining a differential pressure distribution across the backside of the conditioning substrate, whereby different pressures can be applied to specific regions of the backside of the conditioning substrate;

a holder configured to receive and hold both the conditioning substrate backing and the conditioning substrate;

a shaft being connected to the holder; and rotation mechanics capable of rotating the shaft causing the holder, the conditioning substrate backing, and the conditioning substrate to be rotated with the shaft.

6. The conditioning apparatus for use in a CMP system as recited in claim 5, wherein the conditioning substrate backing is configured as a fluid conditioning substrate backing, the fluid conditioning substrate backing being defined by a number of fluid chambers, each of the number of fluid chambers capable of applying a specific pressure to the backside of the conditioning substrate.

7. The conditioning apparatus for use in a CMP system as recited in claim 6, wherein the fluid conditioning substrate backing is configured to allow the differential pressure distribution to be controlled during a CMP process.

8. The conditioning apparatus for use in a CMP system as recited in claim 5, wherein the conditioning substrate is configured to transfer the differential pressure distribution from the backside of the conditioning substrate to the active side of the conditioning substrate.

9. The conditioning apparatus for use in a CMP system as recited in claim 1, further comprising:

rotation mechanics capable of rotating the shaft causing the holder and the conditioning substrate to be rotated with the shaft.

10. The conditioning apparatus for use in a CMP system as recited in claim 1, wherein the centroid of the conditioning substrate represents a point from which all distances to an outer periphery of the conditioning substrate sum to zero.

11. A conditioning apparatus for use in a chemical mechanical planarization (CMP) system, comprising:

a conditioning substrate;

a holder configured to hold the conditioning substrate;

a shaft connected to the holder;

rotation mechanics capable of rotating the shaft causing the holder and the conditioning substrate to be rotated with the shaft; and oscillation mechanics capable of moving a position of the shaft within a region defined by a circular peripheral boundary having a radius that is less than ten percent of a radius defining the outer periphery of the conditioning substrate.

12. A conditioning apparatus for use in a chemical mechanical planarization (CMP) system, comprising:

a conditioning substrate having an active side and a backside; and a conditioning substrate backing capable of defining a differential pressure distribution across the backside of the conditioning substrate, wherein the conditioning substrate backing is configured as a solid conditioning substrate backing, the solid conditioning substrate backing being defined by a number of material regions being differentiated by spring constant values, each of the number of material regions capable of applying a specific pressure to the backside of the conditioning substrate.

* * * * *